US005795085A

United States Patent [19]

Yoo

[11] Patent Number: 5,795,085

[45] Date of Patent: Aug. 18, 1998

[54] CORRECTION TAPE

[76] Inventor: Kwang-Ho Yoo, 103-1102 Hyundae Apt., 1037 Mansu-dong, Namdong-ku, Inchun, Rep. of Korea

[21] Appl. No.: 811,688

[22] Filed: Mar. 5, 1997

[51] Int. Cl.[6] ..... B44C 7/00

[52] U.S. Cl. ..... 400/248; 156/577

[58] Field of Search ..... 400/248; 156/577; 118/237, 200

[56] References Cited

U.S. PATENT DOCUMENTS

| | | | |
|---|---|---|---|
| 5,310,437 | 5/1994 | Tucker | 156/238 |
| 5,393,368 | 2/1995 | Stevens | 156/577 |
| 5,490,898 | 2/1996 | Koyama | 156/540 |
| 5,581,901 | 12/1996 | Takahashi | 33/756 |

*Primary Examiner*—Edgar S. Burr
*Assistant Examiner*—Dave A. Ghatt
*Attorney, Agent, or Firm*—Michael N. Meller

[57] ABSTRACT

The present device relates to a correction tape in which a tape guide is formed at the front part of the outer casing of the correction tape so that it can be revolved in a desired angle as the user wants, and a concave groove is formed at the base part of the tape guide and a magnifying glass part in the outer casing so that the user can easily affirm the part to be corrected. According to the device, a concave groove (13) is formed at the bottom face; and each revolving part (11) is formed at the front face and upper and lower face of the rear end, around the concave groove (13); and at the outer face of the revolving part (11) of rear upper face, a tape guide (1) having a protrusion (12) for adjusting angle is combined with an inserting groove (21) of the inner face of the outer casing (20) having magnifying glass part (23) in order to be revolved; and the inner face of the inserting groove (21) has fitting grooves (22) at regular intervals.

1 Claim, 4 Drawing Sheets

PRIOR ART

CORRECTION TAPE

FIELD OF THE DEVICE

The present device relates to a correction tape, more specifically, a correction tape in which a tape guide is formed at the front part of the outer casing of the correction tape so that it can be revolved in a desired angle as the user wants, and a concave groove is formed at the base part of the tape guide and a magnifying glass part in the outer casing so that the user can easily confirm a letter, word or phrase to be corrected.

PRIOR ARTS

As observing the state where a tape guide is combined at the exit of tape, at the front part of an outer casing of a conventional correction tape as is shown in FIG. 1, the lateral face (03) of the tape body, among the plane face (02) and the lateral face (03), is combined with the contact surface (01') of the tape guide (01) in the same plane. When using the correction tape (S') mentioned above, the user holds the body so that he can press, by using the power of the thumb, the lateral face (03) of the outer casing of the correction tape (S'), which includes a roll of the correction tape, and closely contacts the tape guide (01) to the part to be corrected. Then, the tape guide (01) is pushed aside to cover the correction tape over the part to be corrected. The correction tape (S') described above is advantageous as it can easily correct vertical writing by holding the tape (S') with one's forefinger, instead of his thumb. However, in case of correcting horizontal writing, it is inconvenient for the user to hold the correction tape (S').

As can be shown in FIG. 2, there is another kind of conventional correction tape where the plane face (02) of the correction tape and the contact surface (01') of the tape guide (01) are formed in the same plane. The correction tape (S') like this is advantageous in that it is comfortable to hold the correction tape (S') when correcting a horizontal writing, in contrast to the afore-mentioned tape shown in FIG. 1. However, in case of correcting the error of vertical writing, the user should hold the tape body in other way than in case of correcting vertical writing, or he should correct the error after firstly revolving the document to be corrected to a horizontal direction, whereby causing some difficulties. Further, as the part to be corrected is hidden by the front part of the correction tape during the operation of correction, the correction part cannot be affirmed by eyes, so that the correction tape is sometimes applied to even unnecessary portion, thus it is economically disadvantageous.

As described above, conventional correction tapes have afore-mentioned problems. However, it is economically disadvantageous and inconvenient that one should buy both two types of correction tapes, and to select the correction tape, case by case depending on the parts to be corrected. Thus, the user does not usually buy two kinds of correction tapes, but he uses just one kind of the correction tapes and endure the inconvenience of the selected one.

SUMMARY OF THE DEVICE

The present devisers have paid attention to overcome the problems caused by using the conventional correction tapes, and intended to provide a correction tape which can be properly adjusted by the user in accordance with the item to be corrected, and which prevents waste of tape, by virtue of providing a concave groove and magnifying glass part.

In order to achieve the object, according to the present device, a protrusion for adjusting angle and a revolving part of tape guide (where a concave groove is formed in order to affirm the part to be corrected) are combined to the inserting groove for the revolving part (which is formed at the front part of the outer casing of the correction tape, having magnifying glass part), so that the angle can be adjusted and fitted as desired, by the fitting groove (formed at the inner face of the inserting groove) and the protrusion of the revolving part.

| * Description of symbols of important parts of Figures * | |
|---|---|
| S: Correction tape | 1: tape guide |
| 11: Revolving part | 12: protrusion |
| 13: concave groove | 20: outer casing |
| 21: groove for inserting 11 | 22: fitting groove |
| 23: magnifying glass part | |

DETAILED DESCRIPTION OF THE DEVICE

Now, the present device is described in detail with reference to the attached Figures.

Figure 1:
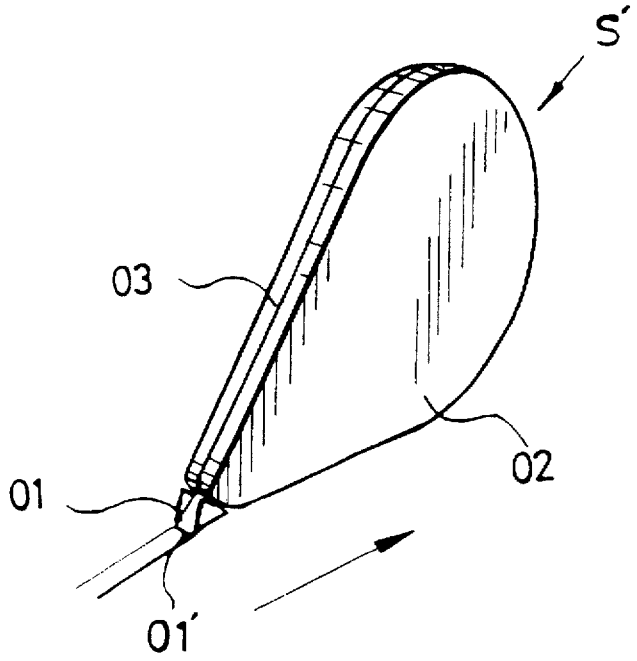
FIG. 1 is a perspective view of a conventional correction tape.
Figure 2:
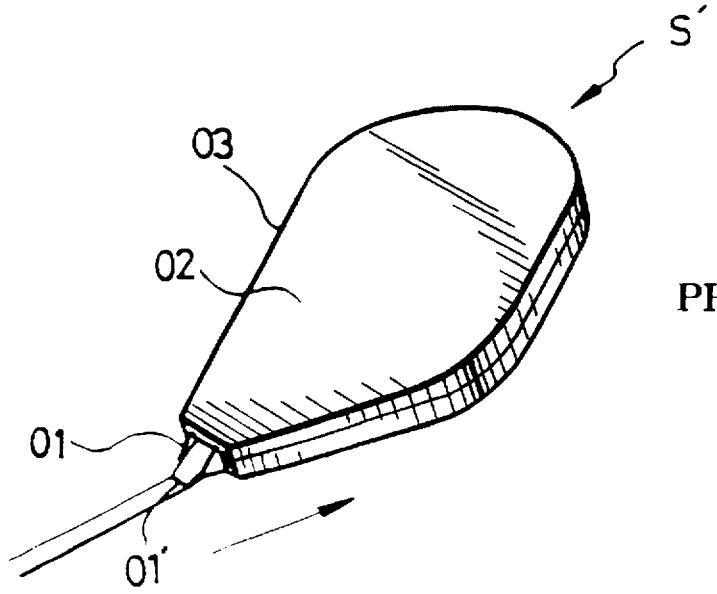
PRIOR ART FIG .2
FIG. 2 is a perspective view of another conventional correction tape.
Figure 3:
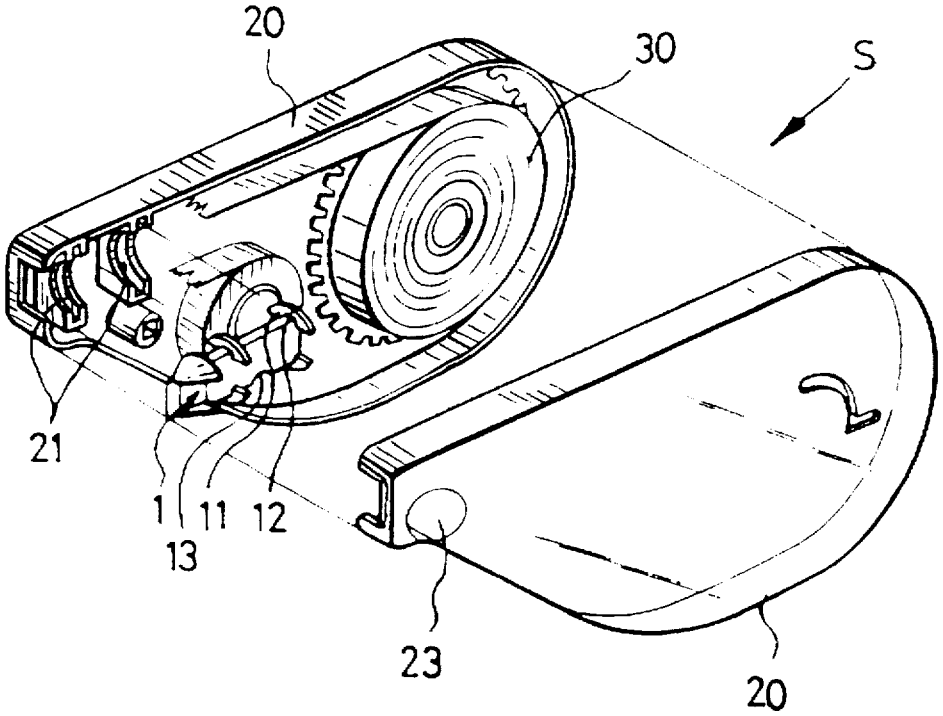
FIG. 3 is an exploded perspective view of the present device.
Figure 4:
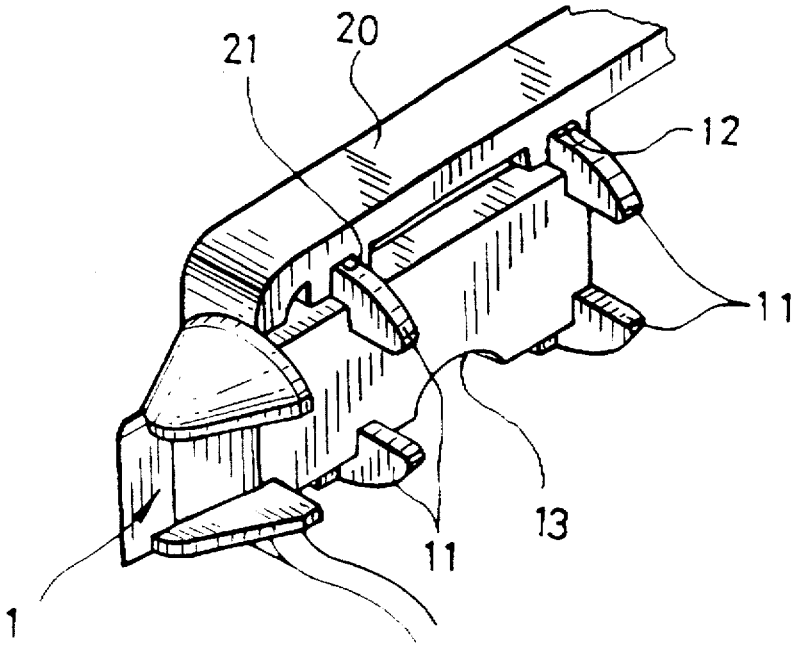
FIG. 4 is a perspective view for showing the combined state of a tape guide, which is an important aspect of the present device.
Figure 5:
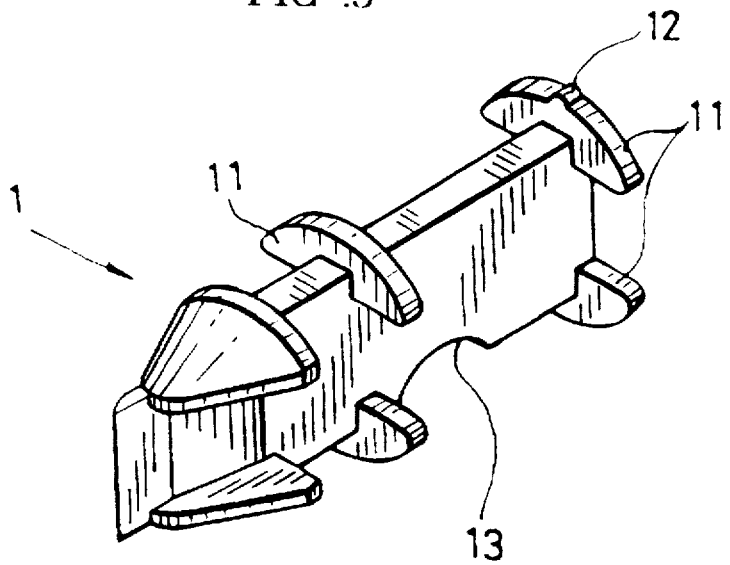
FIG. 5 is a perspective view of the tape guide, which is an important aspect of the present device.
Figure 6:
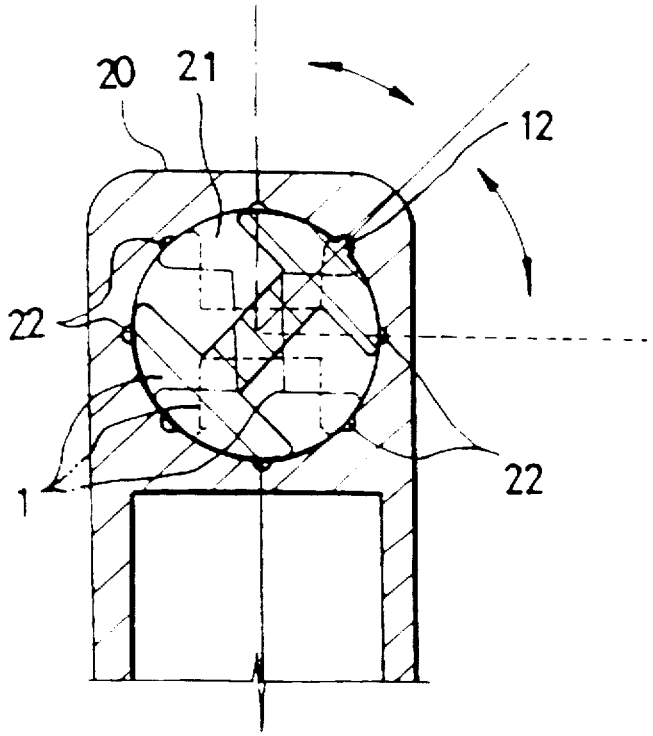
FIG. 6 is a cross-sectional view for showing the operating state of the present device.
Figure 7:
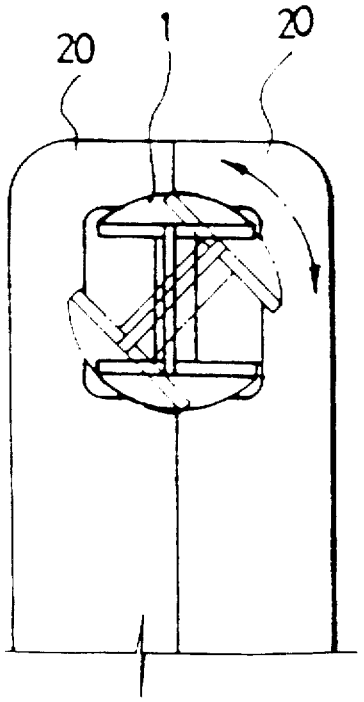
FIG. 7 is a front view for showing the tape guide, which is an important aspect of the present device, provided in an outer casing.
Figure 8:
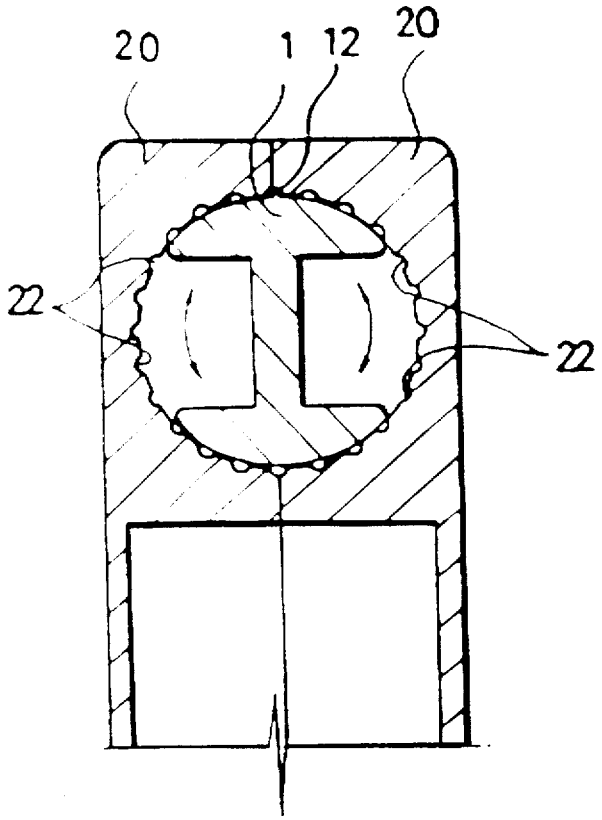
FIG. 8 is a cross-sectional view of another embodiment of the present device.
Figure 9:
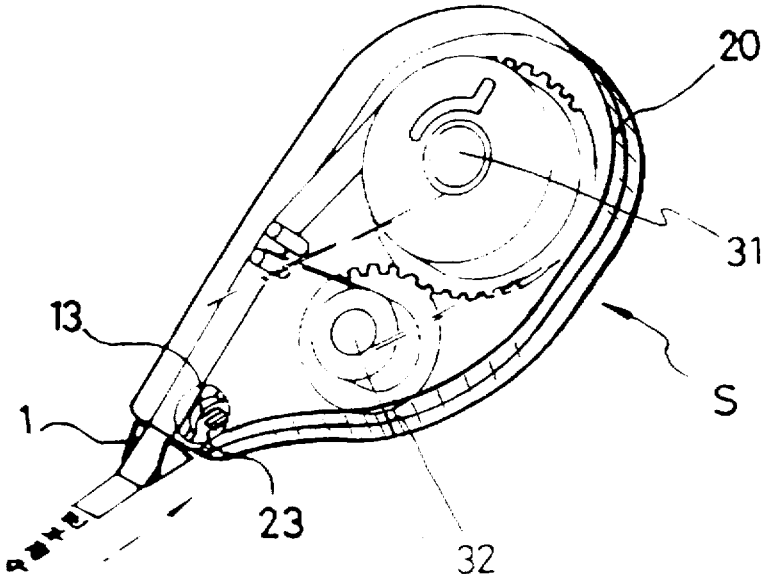
FIG. 9 shows the state of using the correction tape according to the present device.

FIGS. 1 and 2 are perspective views of conventional correction tapes. FIG. 3 is an exploded perspective view of the present device. FIG. 4 is a perspective view for showing the combined state of a tape guide, which is an important aspect of the present device. FIG. 5 is a perspective view of the tape guide. FIG. 6 is a cross-sectional view for showing the operating state of the present device. FIG. 7 is a front view for showing the tape guide, which is an important aspect of the present device, provided in an outer casing. FIG. 8 shows another embodiment of the present device. And, FIG. 9 shows the state of using the correction tape according to the present device.

As can be shown in FIGS. 3 to 5, a concave groove (13) is formed at the bottom face; and each revolving part (11) is formed at the front face and upper and lower face of the rear end, around the concave groove (13); and at the outer face of the revolving part (11) of rear upper face, a tape guide (1) having a protrusion (12) for adjusting angle is combined with an inserting groove (21) of the inner face of the outer casing (20) having magnifying glass part (23) in order to be revolved; and the inner face of the inserting groove (21) has fitting grooves (22) at regular intervals.

In case of another embodiment shown in FIG. 8, the interval of the fitting grooves (22) formed in the inserting groove (21) is made 15°, to improve the choice of angle of the tape guide (1).

In the Figures, symbol 30 shows correction tape.

The effects of using the present device are described below.

When a user find an error in his writing, he may conveniently hold the correction tape (S) according to the present device, of which the tape guide is set as 30° or 45°, and decide whether the present angle is proper to correct the part to be corrected. He can revolve the tape guide (1) in a proper angle, and then contact the tape guide (1) on the paper at the part to be corrected and push it aside. At this time, the user can affirm the part to be corrected through the concave groove (13) at the bottom of the tape guide (1) and the magnifying glass part (23) formed at the front end of the transparent outer casing (20), to prevent the unnecessary part being corrected. If not the structure of the present device like this, the part to be corrected is hidden by the front part of the correction tape (S) and the correction might be applied even to unnecessary portion. Thus, waste of correction tape can be prevented according to the present device.

More concretely speaking, if the part to be corrected is a part of vertical writing, it is convenient to revolve the correction tape and use the tape as illustrated in FIG. 1, while if the part is horizontal writing, as FIG. 2. The correction tape can readily revolved to be properly used in case of the type of writing to be corrected.

When the tape guide (1) is revolved as described above, the protrusion (12) formed in the revolving part (11) of the tape guide (1) is combined with the fitting groove formed in the inserting groove (21) of the revolving part, so that the tape guide (1) would not involve the change of angle any more during the operation of correction. The angle once adjusted by the user does not change by itself unless the user re-adjust the angle depending on his need.

In the description above, the interval of the fitting groove (22), where the protrusion (12) of the revolving part (11) is to be inserted and fixed, is 15° or 45°. But the angle is not restricted to those exemplified. The angle can be varied if required in the range of 0° to 180° unless it departs from the object of the present device.

FIG. 9 shows the state of using the present device with the correction tape arranged on a first roller 31 and the tape released and to be used is arranged on a second roller 32.

As can be shown from the description above, by using the correction tape according to the present invention, one can adjust the direction to be corrected case by case to make the correction easy. In addition, by virtue of the concave groove formed in the tape guide and of the magnifying glass part formed on the outer casing, one can affirm what he corrects, so that waste of correction tape can be prevented. Thus, the correction tape is economically advantageous.

What is claimed is:

1. A correction tape consisting of a first roller to which correction tape has been rolled, in an inner face of an outer casing having a tape exit at a front part; a second roller to which the tape released and used is to be rolled; and a tape guide which guides the correction tape into the exit formed at the front part, wherein a concave groove (13) is formed at a bottom face; and including at least one revolving part (11) formed at a front face and upper and lower face of a rear end, around the concave groove (13); and at an outer face of the revolving part (11) of a rear upper face, a tape guide (1) having a protrusion (12) for adjusting angle is combined with an inserting groove (21) of the inner face of the outer casing (20) in order to be revolved, said outer casing (20) having a magnifying glass part for viewing the concave groove (13); and the inner face of the inserting groove (21) having fitting grooves (2) at regular intervals.

* * * * *